United States Patent [19]

White

[11] Patent Number: 4,653,588

[45] Date of Patent: Mar. 31, 1987

[54] VALVE APPARATUS FOR CONTROLLING COMMUNICATION BETWEEN THE INTERIOR OF A TUBULAR MEMBER AND AN INFLATABLE ELEMENT IN A WELL BORE

[75] Inventor: L. Cameron White, Houston, Tex.

[73] Assignee: N. J. McAllister Petroleum Industries, Inc., Canada

[21] Appl. No.: 786,301

[22] Filed: Oct. 10, 1985

[51] Int. Cl.[4] ..... E21B 23/06

[52] U.S. Cl. ..... 166/374; 166/187; 166/387

[58] Field of Search ..... 166/374, 383, 386, 387, 166/187; 277/34, 34.6

[56] References Cited

U.S. PATENT DOCUMENTS

| | | | |
|---|---|---|---|
| 3,351,349 | 11/1967 | Chenoweth | 277/34 |
| 3,373,820 | 3/1968 | Robinson et al. | 166/187 |
| 3,427,651 | 2/1969 | Bielstein et al. | 166/244 |
| 3,437,142 | 4/1966 | Conover | 277/34 |
| 3,503,445 | 3/1970 | Cochrum et al. | 166/244 |
| 3,542,127 | 11/1970 | Malone | 166/122 |
| 3,581,816 | 6/1971 | Malone | 166/187 |
| 3,776,308 | 12/1973 | Malone | 166/187 |
| 3,818,922 | 6/1974 | Malone | 166/187 |
| 4,063,427 | 12/1977 | Hoffman | 61/100 |
| 4,260,164 | 4/1981 | Baker et al. | 166/187 |
| 4,402,517 | 9/1983 | Wood et al. | 166/187 |
| 4,420,159 | 12/1983 | Wood | 166/187 |
| 4,527,625 | 7/1985 | Wood et al. | 166/187 |
| 4,586,526 | 5/1986 | Reardon | 137/70 |

FOREIGN PATENT DOCUMENTS

| | | | |
|---|---|---|---|
| 1441131 | 6/1976 | United Kingdom | 166/187 |
| 439588 | 3/1975 | U.S.S.R. | 166/187 |

*Primary Examiner*—Stephen J. Novosad
*Assistant Examiner*—William P. Neuder
*Attorney, Agent, or Firm*—Mason M. Campbell

[57] ABSTRACT

Apparatus comprising a valve housing adapted to be supported on a tubular member having a bore therein and a passage in the tubular member and the valve housing for communicating fluid from the interior of the tubular member to an inflatable element supported externally on the tubular member to inflate it. Disposed in the bore is a valve for controlling fluid flow from the interior of the tubular member through the bore to the inflatable element. The valve is restrained from moving responsive to a pressure differential between a higher pressure in an annulus surrounding the tubular member and a lower pressure in the bore, and the apparatus releases the valve for movement responsive to a lower pressure differential from a higher pressure from the interior of the tubular member and a lower pressure in the annulus for further movement to a further configuration responsive to a pressure differential between a higher pressure in the annulus and a lower pressure from the interior of the tubular member.

28 Claims, 7 Drawing Figures

VALVE APPARATUS FOR CONTROLLING COMMUNICATION BETWEEN THE INTERIOR OF A TUBULAR MEMBER AND AN INFLATABLE ELEMENT IN A WELL BORE

BACKGROUND OF THE INVENTION

1. Field of the Invention

The present invention relates to packer inflation systems, and more particularly to valving apparatus which control the inflation of packers.

2. Description of the Background

Control over the inflation of well packers is important to obtain integrity between the packer and the well bore for sealing the annular cavity about a well casing or other tubular element. It is commonly known that the packers may be inflated by various mechanisms, some of which are, for example, U.S. Pat. Nos. 3,503,445, 3,351,349, and 3,373,820.

George Conover in U.S. Pat. No. 3,437,142, issued in 1969, disclosed an inflatable packer for external use on tubular members such as casings, liners, and the like. A valving arrangement is disclosed therein for containing fluid within the interior of the inflatable member after it has been inflated to prevent its return to the tubular member.

Valving arrangements have been known in the prior art to prevent further communication between the interior of the tubular member and the interior of the inflatable element after the inflatable element has been inflated and set in a well bore. Baker et al. in U.S. Pat. No. 4,260,164 teaches such an arrangement wherein its second valve moves from an open position to a closed position and is held in the closed position by a metal retaining ring which engages a counterbore to permanently isolate the interior of the tubular member from the interior of the inflatable element. Other examples of locking means to lock a valve in closed position to prevent further communication between the interior the tubular member and the interior of the inflatable element when the valve closes may be seen in U.S. Pat. Nos. 3,818,922 and 3,776,308. For further examples of valving arrangements to prevent further communication between the interior of the tubular member and the interior of the inflatable element after the inflatable element has been inflated and set in a well bore see, for example, U.S. Pat. Nos. 3,427,651, 3,542,127 and 3,581,816.

A valving arrangement is disclosed in U.S. Pat. No. 4,420,159 to permit the inflation of an inflatable packer element while at the same time equalizing pressure around the rubber seals of the valve or valves to prevent distortion of the seals from undue high differential pressure, and the resulting friction.

Inflatable packers have also been used in other operations, such as sealing the annular space between a jacket and a piling. For an example of this, see U.S. Pat. No. 4,063,427.

SUMMARY OF THE INVENTION

One of the objects of the invention of the present method and apparatus is to provide a new and improved method and apparatus for controlling fluid communication between the interior of a tubular member and an inflatable element supported on the exterior thereof to inflate the element in a well bore. In accordance, the present invention provides apparatus having means to restrain a valve means disposed in the apparatus for controlling fluid flow from moving responsive to a pressure differential between a higher pressure in an annulus surrounding the tubular member and a lower pressure in the bore means in which the valve means is disposed. It is also an object of the present invention that the means to restrain include means to release the valve means for movement responsive to a lower pressure differential between a higher pressure from the interior of the tubular member and a lower pressure in the annulus, and that when so released, allow further movement of the valve means responsive to a pressure differential between a higher pressure in the annulus and a lower pressure from the interior of the tubular member.

It is another object that the valve means opens in response to pressure from the interior of the tubular member to allow fluid flow from the interior of the tubular member to the inflatable element. In accordance, it is an object of the present invention that the means to release include a means to retain the valve means in a configuration to prevent communication to the inflatable element until a first predetermined pressure is reached and which then releases the valve means for communicating fluid to the inflatable element.

Another object of the present invention is that the means to release the valve means for movement responsive to a pressure from the interior of the tubular member, when so released, allow further movement of the valve means responsive to annulus pressure so that communication between the interior of the tubular member through the valve apparatus to the inflatable element is prevented.

An even further object of the present invention and method provides apparatus for locking a valve means in a first configuration to restrain movement of the valve means responsive to a pressure differential between a higher pressure in an annulus surrounding the tubular member and a lower pressure in the bore means, and further provides means for releasing the valve means for movement responsive to a pressure differential between a higher pressure from the interior of the tubular member and a lower pressure in the annulus. The means for releasing further including means for moving the valve means to a second configuration responsive to a first predetermined pressure differential between a higher pressure from the interior of the tubular member and a lower pressure in the annulus to communicate fluid from the interior of the tubular member to the interior of an inflatable element supported externally on the tubular member to inflate it. Further, the valve means includes means for moving the valve means to a third configuration responsive to a pressure differential between a higher pressure in the annulus and a lower pressure from the interior of the tubular member to close and block off communication between the interior of the tubular member and the inflatable element, and includes means for restraining the valve means from further movement responsive to a pressure differential between a higher pressure from the interior of the tubular member and a lower pressure in the annulus.

It is further an object of the present invention that the invention may provide a means by which fluid surge is restrained from prematurely causing the closing off of fluid flow to the inflatable element before its inflation thereof.

It is further an object of the present invention to provide valve control apparatus for controlling fluid communication between the interior of a tubular member and the interior of an inflatable element supported externally on the tubular member, which apparatus may include first and second valve means. In accordance, means to restrain the valve means from moving responsive to a pressure differential between a higher pressure in the annulus and a lower pressure in the bore means is associated with the first valve means so that the first valve means may be retained in a configuration to prevent communication to the inflatable element until the first predetermined pressure is reached and which may then be released responsive to a lower pressure differential between a higher pressure from the interior of the tubular member and a lower pressure in the annulus for communicating fluid through the second valve means to the inflatable element, and that when so released, allow further movement of the valve means responsive to a pressure differential between a higher pressure in the annulus and a lower pressure from the interior of the tubular member.

It is further an object of the present invention that the second valve means moves responsive to a second predetermined pressure which may be the same, higher or lower than the first predetermined pressure. In accordance, it is an object of the present invention that the means by which fluid surge is restrained from prematurely causing the closing off of fluid flow to the inflatable element before its inflation thereof may be associated with the second valve means. In accordance with this object, a surge passage means is constructed in the second valve means in order that fluid surge may be restrained from prematurely causing the second valve means to move from a configuration, in which fluid is communicated through the surge passage means to the inflatable element, to a configuration in which fluid flow to the inflatable element is blocked off. In further accordance with this object, the surge passage means cooperates with a means to retain the second valve in an open configuration until the second predetermined pressure is reached and which then releases the second valve means so that it may move to block off further communication between the tubular member and the inflatable element which might tend to cause overinflation of the element. In further accordance with this object, the second valve means moves responsive to the second pressure differential between a higher pressure from the inflatable element and a lower pressure in the annulus.

Still yet a further object of the present invention is that the means to release the valve means for further movement responsive to a pressure differential between a higher pressure in the annulus and a lower pressure from the interior of the tubular member allow further movement of the valve means responsive to annulus pressure, and in accordance provide means so that the first valve means may move to a further closed configuration and block fluid flow through the valve means to the inflatable element. In accordance with this object, the bore means in which the first valve means is disposed has an inlet passage for communicating the interior of the tubular member with the first bore means and includes a bore extension that extends past the inlet passage. In further accordance with this object, the first valve means moves into the bore extension to its further closed configuration responsive to a third predetermined pressure differential and a means is provided whereby fluid may be displaced from the extension as the first valve means moves into the extension.

An even further object of the present invention is to provide a means by which the valve means may be restrained from allowing further communication between the interior of the tubular member and the inflatable element by means of the apparatus of the present invention. In accordance it is an object that the present invention provides a means by which the first valve means, when it has assumed its further closed configuration, may be restrained from further movement. In accordance with this object, a means is provided to restrain fluid leakage into the extension of the bore means, thus providing a means by which the first valve means is restrained from further movement responsive to a higher pressure in the interior of the tubular member and a lower pressure in the annulus. In further accordance with this object, further communication between the interior of the tubular member and the inflatable element is restrained. Accordingly, for any reason should the inflatable element become punctured or lose its inflate pressure, further communication from the interior of the tubular member through the valve control apparatus to the inflatable element is blocked. This prevents further fluid flow from the interior of the tubular member through the valve control apparatus and out of the punctured element into the annulus, while likewise preventing further fluid flow from the annulus into the punctured element and through the control valve apparatus to the interior of the tubular member. Also in accordance with this object, it is a further object that changes in annulus pressure or the pressure in the interior of the tubular member may not cause further fluid flow to the inflatable element. It is likewise an object that these changes in annulus pressure or the pressure in the interior of the tubular member do not cause fluid flow from the inflatable element through the apparatus.

In further accordance with the above objects, the first valve means includes means for locking the valve means in a first configuration, and further includes means for releasing the valve means for movement. Also in accordance, the first valve means further includes means for moving the valve means to a second configuration responsive to a first predetermined pressure differential for communicating fluid through the second valve means to the inflatable element, and also includes means for moving the valve means to a third configuration to close and block off communication between the interior of the tubular member and the inflatable element. Accordingly, the first valve means also includes means for restraining the valve means from further movement so that the first valve means is restrained from further movement, blocking further communication, by means of the present invention, between the interior of the tubular member and the inflatable element.

DESCRIPTION OF THE DRAWINGS

The invention may be more fully understood by reference to the following description of the preferred embodiment in conjunction with the drawings and wherein.

DESCRIPTION OF THE PREFERRED EMBODIMENTS

Figure 1:
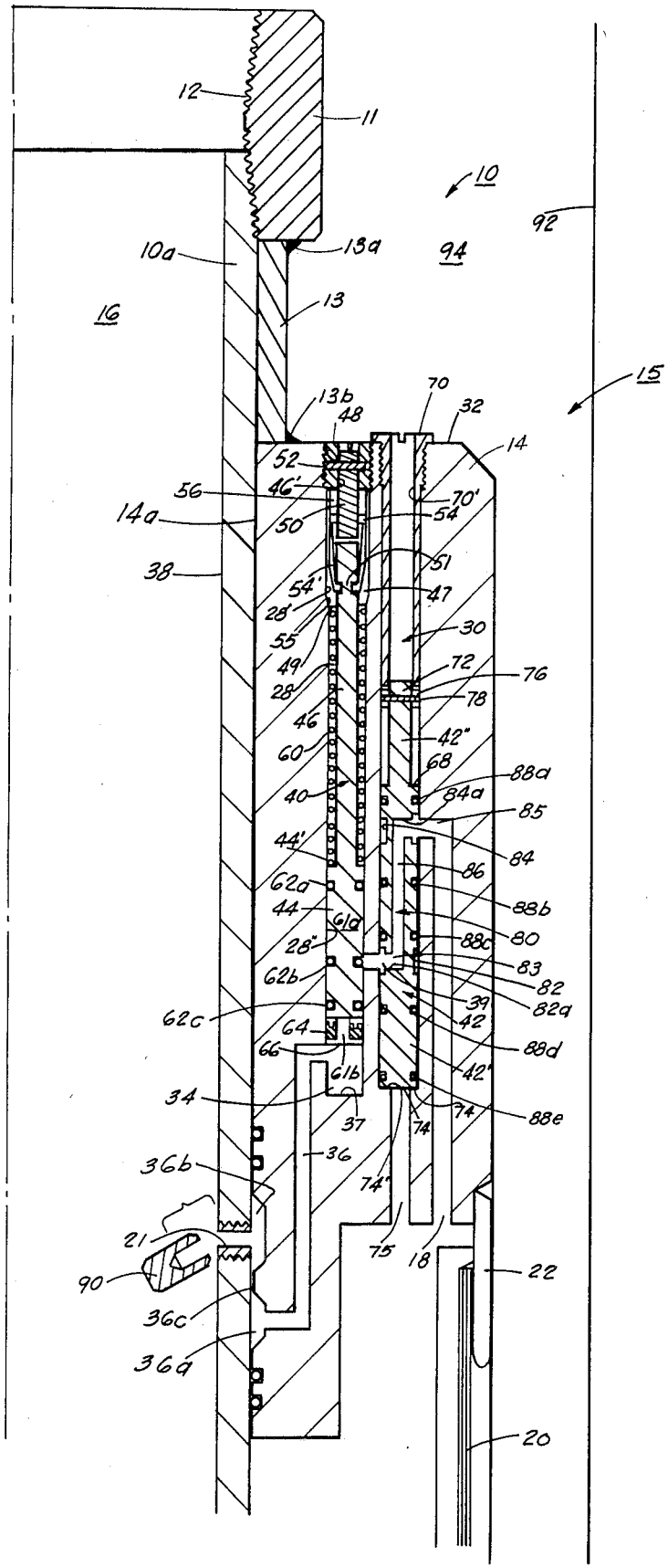
FIG. 1 is a sectional view illustrating the valve apparatus of the present invention shown included in a valve body carried on a tubular member.

Referring to FIGS. 1–4, a portion of a tubular member 10 is shown. This type of member could be used for any embodiment of the present invention as illustrated and the present invention may also be used with a casing packer. Member 10 includes a collar 11 which is secured to an upper and lower tubular element of member 10 by suitable means, such as threads 12. A tubular sleeve 13 having a suitable bore so that sleeve 13 may be slipped longitudinally over lower tubular element 10*a* of member 10, surrounds lower element 10*a* with its upper annular surface in abutment with the lower annular surface of collar 11 and is secured thereto by suitable means such as welds 13*a*. A valve body 14 having a suitable bore 14*a* so that body 14 may be slipped longitudinally over element 10*a*, surrounds member 10 with its upper annular end in abutment with the annular surface of sleeve 13 and is secured thereto by suitable means such as welds 13*b*. Valve body 14 includes valve apparatus 15 for communicating fluid from the interior 16 of tubular member 10 to a fluid channel 18 leading to the inflatable or packing, element 20 carried externally on tubular member 10, and is positioned on element 10*a* in relation to passage or port 21 in element 10*a* for receiving inflating fluid from the interior 16 of the tubular member 10 to communicate fluid to the inflatable element 20.

Generally, the inflatable element 20, which may be spaced elements 20, is carried in a manner well known in the art on the exterior annular surface of tubular member 10. For example, one end of the valve body 14 may be secured to and receives one end of a support 22, the inflatable element 20, and the other unseen end portion of the element support may be slidably received on an unseen annular skirt carried on tubular member 10 to accommodate longitudinal movement of the inflatable element 20 as it inflates. A seal means as known to the art is provided between the slidable end portion and the skirt for sealing engagement therebetween. Any inflatable element however, which is suitable for use with the present invention may also be used and the aforementioned inflatable element 20 is only exemplary and various changes in its details are within the scope of the invention.

The valve body 14 may be somewhat thickened relative to the other portions of tubular member 10 which are employed in the well string to provide ample wall thickness and space for receiving the valve apparatus 15.

The valve body 14 is provided with a first cylindrical bore means 28 and a second cylindrical bore means 30 which extend axially downwards from an upper annular surface 32 of the valve body 14 in the thickened wall portion of body 14. The first bore means 28 has a counterbore extension 34 having a same diameter as bore means 28 which extends downwards past an inlet passage 36 to terminate in a closed end 37. The inlet passage is somewhat "S" shaped and has its inlet in communication with a first annular passage 36*a* formed by a recessed portion on the inner annular surface of body 14. A second annular passage 36*b* formed by a second recessed portion on the inner annular surface of body 14 communicates with passage 36*a* by means of a third or constricting annular passage 36*c*, the purpose of which will be described in detail later, formed by a third recessed portion on the inner annular surface of body 14. The inlet passage 36, together with port 21 and passages 36*a*, 36*b* and 36*c* joins interior surface 38 of tubular member 10 with the first bore means 28 and which when open, communicates the interior 16 of tubular member 10 with bore means 28. A passage means 39, which may be formed by drilling or the like, joins bore means 28 and 30 for communicating fluid and pressure from bore means 28 to bore means 30.

A first valve means 40 is disposed in bore means 28 and a second valve means 42 is disposed in bore means 30. The first valve means 40 includes a cylindrical piston valve portion 44 and a cylindrical valve stem 46 extending axially upwards from the body of portion 44. An annular shoulder 44' extends radially inwards from the upper cylindrical edge of portion 44 and joins valve portion 44 and valve stem 46 together. A plug 48 is threadably engaged in the open end of bore means 28 having an axial bore 48' therethrough for communicating annulus fluid and pressure to the upper end of bore means 40. Slidably disposed in bore 48' above the upper end of valve means 40 is a cylindrical rod 50 which is secured to plug 48 by means of a shear pin 52. The rod 50 has a diameter which may be substantially the same as the diameter of valve stem 46 and may be disposed in bore 48' above the upper end of valve means 40 so that a gap exists between the lower end of rod 50 and the upper end of valve means 40.

Figure 5:
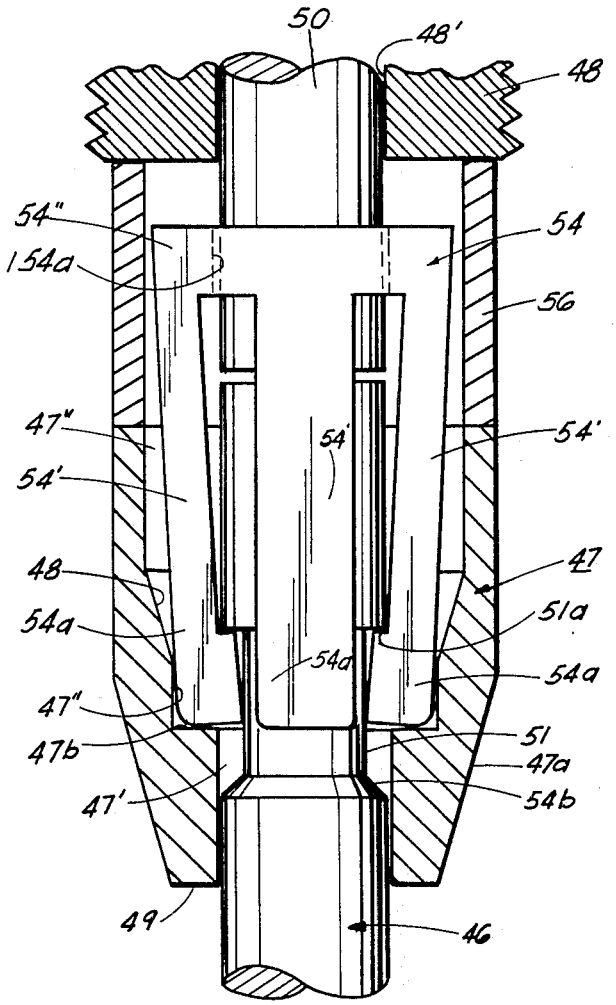
FIG. 5 is an enlarged sectional view of the collet mechanism and the collet opening retainer ring of FIG. 1, with the arms of the collet mechanism shown engaged in a groove on the valve means.

Bore means 28 includes a lower narrower bored portion 28" which is the same diameter as extension 34 and an upper bored portion 28' which is counterbored to a larger diameter. A tapered annular shoulder 55 extends radially inwards and downwards from bored portion 28' and joins the two bored portions 28' and 28" together. A collet opening retainer ring 47, which may best be seen in FIG. 5, having a tapered circular seat 47*a* which surrounds the lower end of ring 47 is disposed in portion 28' with its seat 47*a* in abutment with shoulder 55 and with its upper annular end in abutment with a lower annular surface of a cylindrical spacer ring 56. The spacer ring 56 has its upper annular surface in abutment with the lower annular surface of plug 48 and positions ring 47 in bored portion 28' so that the lower end of ring 47 is in abutment with shoulder 55. The ring 47 includes a first bored portion 47' hvaing a diameter somewhat larger than the diameter of valve stem 46 and surrounds stem 46 with the stem 46 slidably extending through bore 47'. A second counterbored portion 47'' having a larger diameter is disposed above portion 47' with the portions 47' and 47'' being joined by an annularly extending shoulder **47*b*. Extending upwardly from the second countered bored portion 47'' is a tapered annular shoulder 48. The tapered shoulder 48 widens as it extends upwardly and a third counterbored portion 47' having a larger diameter than counterbored portion 47'' extends upwardly from tapered shoulder 48**.

A collet mechanism 54 having a plurality of arms 54' is slidably disposed in upper portion 28'. The mechanism 54 includes a bore **154*a*, as indicated by the dashed lines in FIG. 5, having a diameter somewhat larger than the diameter of rod 50 and valve stem 46. The lower end of rod 50 is disposed in bore 54*a* and the mechanism 54 is disposed in portion 28' with the lower ends of its arms 54' both in abutment with tapered shoulder 48 and compressed inwardly by shoulder 48 so that the lower ends of arms 54' are sprung inwards to engage with an annular groove 51 surrounding stem 46. The groove 51 includes an upper annular shoulder 51*a* with which a hook-like structure 54*a* at the lower end of arms 54' engages to restrain the downwards movement of valve means 40. The hook-like structure 54*a* includes flat surfaces which abut against shoulder 51*a* to lock and prevent downwards movement of valve means 40 when the arms 54' are engaged with groove 51, and groove 51 includes a lower outwardly tapered shoulder 54*b*, the purpose of which will be described in detail later. As may be appreciated the abutment of the lower ends of arms 54' with shoulder 48 and the engagement of hook-like structure 54*a* of arms 54' with shoulder 51*a* of groove 51 together with the limited depth of counterbored portion 28', cooperate to lock and restrain the movement of valve means 40 responsive to annulus pressure and prevents the valve means 40 from moving into extension 34 past inlet passage 36**.

A spring 60 surrounds valve stem 46 with its lower end in abutment with shoulder 44' and extends upwardly in a somewhat compressed manner around stem 46 with its opposite end in abutment with the lower annular surface 49 of collet opening retainer ring 47. The compression of the spring 60 aids in wedging the lower ends of arms 54' downward against tapered shoulder 48 and may allow a small gap, as previously mentioned, to exist between the upper end of valve stem 46 and the lower end of rod 50. The retainer ring 47, as previously mentioned, is disposed in bored portion 28' in abutment with tapered shoulder 55, being held in position by spacer ring 56 and plug 48 as it is screwed into bore 28'', pressing surface **47*a* of ring 47 in abutment with shoulder 55 however, for example, in a further version the retainer ring 47 may be disposed in bore means 28 by such means as as a threaded engagement therein and may be positioned in bore means 28 as previously described to provide an upper fixed abutment surface against which spring 60 may be compressed and in a further alternate version, the length of ring 47 may be such that a spacer ring such as ring 56** is not required.

As may be further appreciated, with collet mechanism 54 engaged with valve means 40 and with its arms 54' in abutment with shoulder 48 and compressed inwards, the lower end 66 of valve portion 44 remains above inlet passage 36, allowing communication between inlet passage 36 and bore means 28. In accordance, the combined lengths of the valve means 40 when engaged with mechanism 54 and the depth of counterbored portion 28' cooperate to accomplish this purpose.

Figure 6:
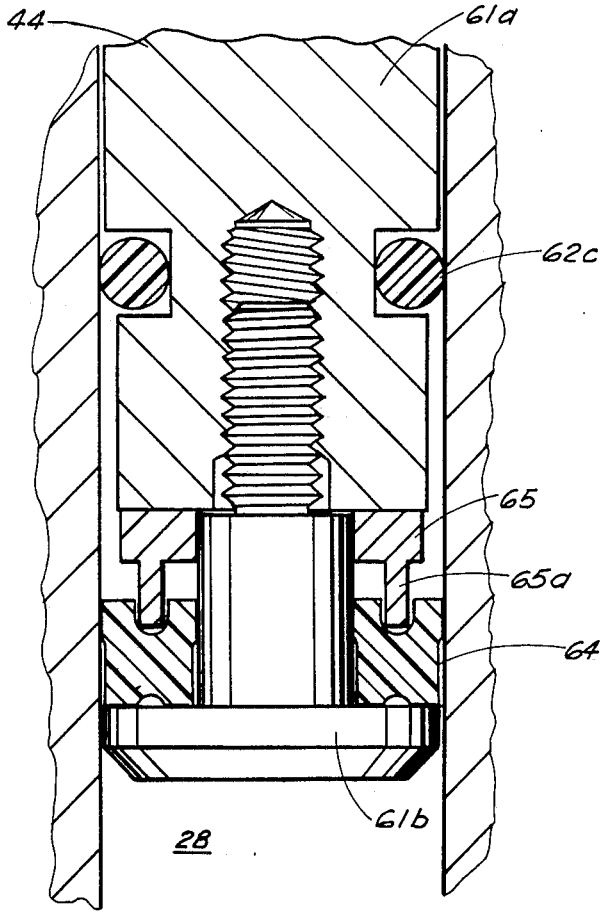
FIG. 6 is a detail of the lower end of a valve means as shown in FIG. 1, according to the present invention.

Referring to FIG. 6, the valve means 40 may include an opening valve section **61*a* comprising valve stem 46 and the upper portion of piston valve portion 44, and also may include a bottom end opening valve section 61*b* that is disposed below section 61*a* and comprises the lower portion of piston valve portion 44, with section 61*b* attached to section 61*a*** by means such as threads.

A number of annular seal members **62*a*, 62*b* and 62*c* are disposed in annular grooves formed on the surface of section 61*a* of valve portion 44 to provide sealing and slidable engagement between the walls of bore means 28 and valve means 40 as will be appreciated. The seal members 62*a*, 62*b* and 62*c* assist in conducting fluid to the inflatable element 20 when desired and inhibit fluid flow to the inflatable element 20** when desired as will be described later in greater detail.

A further seal member 64 is also disposed in an annular groove which may be formed by including opposed annular voids on the opposing abutment ends of sections **61*a* and 61*b* as best seen in FIG. 6 so that the seal member 64 may be disposed therein before the assembly of sections 61*a* and 61*b* to avoid damage to the seal member 64. The seal member 64 is disposed in a groove which may be formed by these voids for sealing and slidable engagement between the walls of bore means 28 and valve means 40 as will be further appreciated and is configured to seal against flow in the downwards direction around seal 64 while allowing flow in the opposite upwards direction. One version of seal member 64 may comprise a "PolyPak" or cup seal having its wiper edge tapered upwards in bore means 28'' to allow one way flow in an upwards direction around seal member 64 while restraining leakage downwards around seal member 64. The seal includes an annular ring 65 having an annular extension 65*a* that is disposed between seal member 64 and the bottom of section 61*a* with its upper annular surface in abutment with the lower surface of 61*a* and with its extension 65*a* extending downwards into the annular "cup" of seal member 64** and abutting against the lower annular surface of the bottom of the "cup" in a manner known to the art so that one way sealing is effected.

A further unshown version of the invention has a modified valve means similar to valve means 40 that includes an annular seal member such as seal members **62*a*, 62*b* and 62*c* in place of seal member 64. The modified valve means also includes a passage means in a portion similar to valve portion 44 for communicating in particular extension 34 of the bore means 28 below the seal member with the bore means 28 above the seal member. A check valve is further included in the passage means such that flow from the bore means 28 below the seal member flows through the passage means and the check valve to the bore means 28 above the seal member, while flow from the bore means 28 above the seal member is restrained from leaking to the bore means 28** below the seal member by the annular seal member and the closing of the check valve.

A plurality of annular seal members **67*a* and 67*b* are disposed in annular grooves formed on the walls of the bore 14*a* of body 14 to provide sealing engagement between the outer tubular wall of element 10*a* and the walls of the bore 14*a* of body 14 and surround port 21. Seal members 67*b* isolate port 21 and annular passage 36*a* from the inflatable element 20 so that there is no communication between the interior 16 of tubular member 10 and the inflatable element 20 along the walls of bore 14***a* and the outer tubular wall of element 10*a*. In addition, seal members 67*a* aid in isolating port 21 from the annulus 94 so that there may be no communication between the interior 16 of tubular member 10 and the annulus 94 along the walls of bore 14*a* and the outer tubular wall of element 10*a*.

The second valve means 42 is disposed in the second bore means 30 in an open configuration so that communication is available from bore means 28 through passage means 39, through valve means 42 to fluid channel 18, and hence to the inflatable element 20. The valve means 42 includes a cylindrical piston valve portion 42' and a narrower upper cylindrical valve stem portion 42'' joined together by an annular shoulder 68. A plug 70 having a cylindrical bore 70' forming a counterbore to bore means 30 is threadably engaged adjacent the open end of bore means 30 and extends a length of bore means 30. Extending into the lower end of bore 70' is valve stem 42'', the diameter of which is cooperative with the diameter of bore 70' such that valve stem 42'' may freely move with axial motion along the axis of bore 42''.

The bore means 30 terminates in an end 74 having a radially extending annular shoulder 74'. The shoulder 74' surrounds a passage means 75 which extends downwards through the wall of the valve body 14 to the inflatable element 20 for communicating the lower end 74 of bore means 30 with element 20. Disposed in end 74 of bore means 30 with its lower surface in abutment with shoulder 74' is piston valve portion 42'. With the valve means 42 so disposed, a flange portion 76 having a bore that forms an extension of bore 70', which as shown may extend downward from the lower annular surface of plug 70, surrounds valve stem 42'' with the stem 42'' extending into its bore 70'. A means such as a shear pin 78 which may be of the same, higher or lower strength as shear pin 52 secures the upper end 72 of valve stem 42' to the flange portion 76, and as shown, with valve means 42 secured to the flange portion 76 by means such as shear pin 78, the lengths of the valve means 42, bore means 30, plug 70, as well as flange portion 76, cooperate such that the lower portion 42' of valve means 42 abuts with shoulder 74' of end 74, with the upper portion 42'' of valve means 42 extending into bore 70'.

Included is a means by which fluid surge is restrained from prematurely closing off of fluid flow to the inflatable element 20 before its inflation thereof. The means by which fluid surge is restrained from prematurely closing off of fluid flow to the inflatable element 20 is included with valve means 42 and cooperates with the valve means 42 so that the closing off of fluid flow to the inflatable element 20 may occur at a predetermined pressure differential which may be the same, higher or even lower than the predetermined pressure differential by which valve means 40 opens.

Referring again to FIGS. 1–4, valve means 42 is shown having a surge passage means 80 which cooperates with shear pin 78 and valve means 42 to aid in restraining the premature movement of valve means 30 responsive to fluid surge. As shown, an annular reduced portion 82 extending radially inwards from the surface of portion 42' surrounds the inlet to surge passage means 80 and a similar annular reduced portion 84 extending radially inwards from the surface of portion 42' surrounds the outlet of surge passage means 80. The surge passage means 80 is disposed within valve means 42 so that when the lower end of valve means 42 abuts against with shoulder 74', reduced portion 82 is aligned with passage means 39 and its other reduced portion 84 is aligned with the inlet to fluid channel 18, allowing communication through passage means 39 into reduced portion 82 and into the inlet of surge passage means 80, out of surge passage means 80 into reduced portion 84 and into fluid channel 18 to the inflatable element 20.

Further, its inlet 83 and outlet 85 portions are joined by an intermediate passage section 86 which is disposed along the axis of valve means 42 normal to its inlet 83 and outlet 85. The inlet 83 and outlet 85 portions of surge passage means 80 include complementary opposed facing surfaces 82*a* and 84*a* having equal surface area to aid in absorbing fluid surge. These surfaces are parallel to each other so that the pressure exerted by the surging fluid as it passes through surge passage means 80 will exert equal and opposite axial forces on these surfaces 82*a* and 84*a*, and hence valve means 42. These opposite forces cancel each other out, and as is further appreciated the direction of the intermediate passage section 86 is along the axis of valve means 42 so that forces generated as the fluid surges through intermediate passage section 86 are balanced and no further substantial net axial force is generated on valve means 42. This allows valve means 42 to close at a predetermined pressure differential as described in greater detail later which may be the same, higher or even lower than the pressure differential by which valve means 40 opens.

Suitable seal members 88*a*, 88*b*, 88*c* 88*d* and 88*e* are disposed in annular grooves on the surface on the piston valve portion 42' for sealing and slidable engagement with the walls of bore means 30 and valve means 42. Members 88*a* and 88*b* surround reduced portion 84, members 88*c* and 88*d* surround reduced portion 82 and member 88*e* is located near the lower portion of valve portion 42'. These members 88*a*, 88*b*, 88*c*, 88*d* and 88*e* aid in conducting fluid to the inflatable element 20, when desired, and also aid in inhibiting fluid flow from the inflatable element 20, as will be described in greater detail later.

A frangible member 90, which may be plastic, is threadably engaged in the opening to port 21 or passage 21 and closes off communication between the interior 16 of tubular member 10 and port 21 and hence closes off communication between the interior 16 of tubular member 10 and bore means 28.

The bore means 28 and 30 may be arranged radially as shown or may be disposed along an arc in body 14 with the inlet passage 36 disposed tangentially therein.

Figure 7:
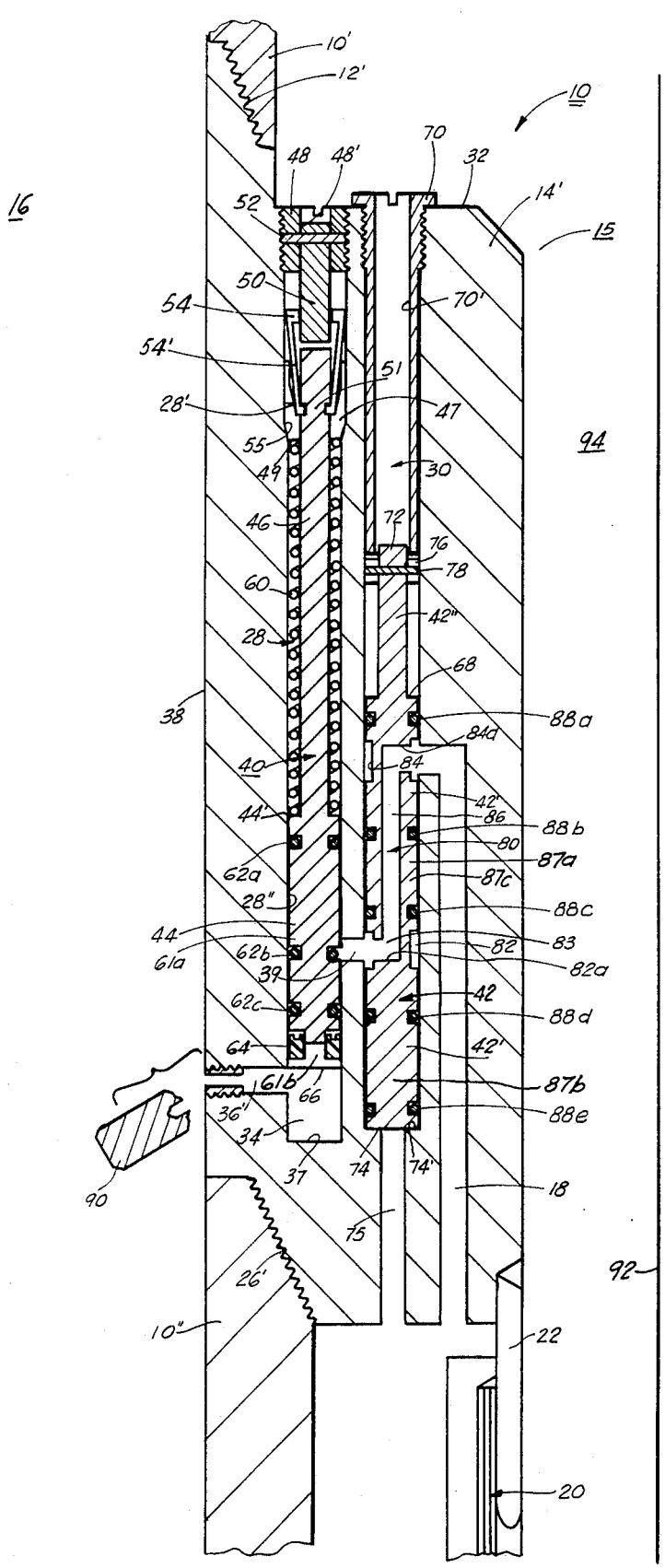
FIG. 7 is a sectional view illustrating a further version of the valve apparatus of the present invention shown included in a valve collar secured to a tubular member.

As shown in FIG. 7, a further version of the present invention is shown in which member 10 may include a casing joint of casing sub for connection to other tubular member and is secured by suitable means, such as threads 12' to a valve collar 14', secured to a body portion 10' of the tubular member 10. Valve collar 14' includes valve apparatus 15 and may be somewhat thickened relative to the other portions of tubular member 10 and may be secured to a lower element 10'' of tubular member 10 by suitable means, such as threads 26'. An inlet passage 36', which may be radial joins interior surface 38 of tubular member 10 with the bore means 28 and the frangible member 90 is threadably engaged in the opening to passage 36'.

As the tubular member 10 including the valve apparatus 15 and the inflatable element 20 are lowered into the well bore or cased hole 92, pressure from an annulus 94 between the well bore wall and the tubular member 10 is communicated through bores in plugs 48 and 70 to act on the upper and lower ends of rod 50 and the upper ends of valve means 40 and 42. As the member 10 is lowered further into the well bore 92, this pressure increases, and accordingly the pressure on the upper and lower ends of rod 50 and the upper ends of valve means 40 and 42 increases likewise. As the pressure forces acting the ends of rod 50 are equal but opposed, shearing of pin 52 due to annulus 94 pressure is prevented.

As the tubular member 10 continues to be lowered, the annulus 94 pressure continues to increase and longitudinal downwards movement of valve means 40 responsive to a pressure differential between an increasing higher pressure in the annulus 94 acting on the upper end of valve means 40 and a lower pressure enclosed in the bore means 28 of the valve apparatus 15 by the frangible member 90 acting on the lower end of valve means 40 is restrained. The longitudinal downwards movement responsive to this pressure differential is restrained both by the abutment of the lower ends of arms 54' of collect mechanism 54 with shoulder 48 and the inwards compression of arms 54, causing the arms 54' to engage groove 51 on valve means 40 and accordingly retains and locks valve means 40 in the configuration shown in FIG. 1.

As valve means 42 is disposed in bore means 30 in a configuration so that its lower surface is in abutment with shoulder 74', downwards movement of valve means 42 responsive to annulus pressure is prevented and valve means 42 remains in an open configuration so that communication is available from bore means 28 through passage means 39, through valve means 42 by means of surge passage means 80 and reduced portions 82 and 83 to channel 18, and hence to the inflatable element 20.

When it is desired to inflate the inflatable element 20 on the tubular member 10, a suitable means is dropped, lowered or forced through the interior of the tubular member 10 to shear the frangible member 90 as shown in FIG. 1 and expose inlet passage 36 to the interior 16 of tubular member 10. Thereafter, fluid pressure may be passed from the interior 16 of tubular member 10 through port 21 into annular passage **36*b* and into annular passage 36*a* by means of restricting annular passage 36*c* which aids in screening out large particles from the fluid as the fluid is communicated from passage 36*b* to passage 36*a*. From passage 36*a*, the fluid is communicated to passage 36 and into bore means 28 to act on the lower end of valve means 40 seated within bore means 28, and longitudinally move valve means 40 upwards to close any gap that may exist between the lower end of rod 50 and the upper end of valve means 40 so that the lower end of rod 50 and the upper end of valve means 40 are in abutment. As shown in FIG. 1, seal means 64 is positioned above inlet passage 36 and accordingly offers no restriction to passage of fluid from passage 36 into bore means 28 to act on the lower end of valve means 40**.

However, as fluid pressure acts against lower end 66 of valve means 40, shear pin 52 retains valve means 40 in its closed position and seal member **62*c* restrains fluid leakage past valve means 40 to passage means 39. The shear pin 52 continues to retain valve means 40 in its closed configuration until a pressure differential which is usually lower than the previously mentioned pressure differential (with the exception of for example of shallow wells) which may be 750–3000 p.s.i. by way of example only, between a higher pressure in bore means 28 acting on lower end 66 of valve means 40 and a lower pressure in the annulus 94 acting on the upper end of rod 50 and the upper end of valve means 40 causes shear pin 52 to shear, releasing rod 50 and valve means 40 to move upwardly, as shown in FIG. 2, further compressing spring 60 between abutment surfaces 44' and 49**.

As valve means 40 begins to move upwardly, the upper end of valve means 40 abuts against the lower end of rod 50 so that rod 50 moves upwardly with valve means 40. As valve means 40 begins to move upwardly, collet mechanism 54 rises also and the lower ends of arms 54' begin to spring outwardly due to the widening of tapered shoulder 48. To aid in this disengagement, the lower tapered shoulder **54*b* aids in springing the arms 54' outwardly as valve means 40 moves upwardly relative to the collet mechanism 54, further disengaging the flat surfaces of hook-like structures 54*a* from shoulder 51*a*. This aids in allowing the arms 54' to ride downwards along valve stem 46 and also aids in helping the arms 54' to fully disengage from groove 51 so that valve means 40 may assume the configuration shown in FIG. 2**.

Figure 2:
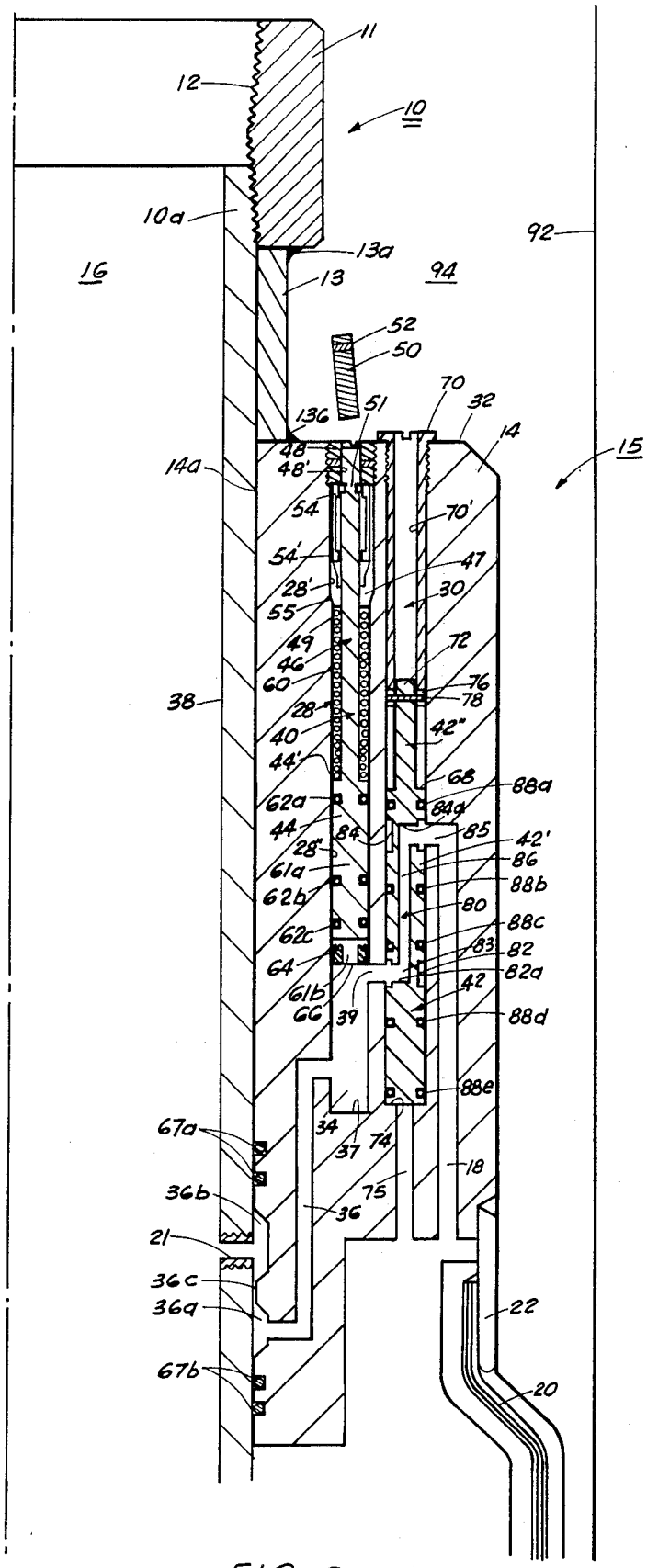
FIG. 2 is a sectional view similar to FIG. 1 and illustrating the relationship of a first and second valve means when fluid is communicated to the interior of the inflatable element for inflation thereof.

As valve means 40 assumes the configuration shown in FIG. 2, rod 50 is ejected into the annulus 94 and the upper end of valve stem 46 passes through bore **154*a* of collet mechanism 54 and into bore 48' of plug 48. Further upwards movement of valve means 40 to the configuration as shown in FIG. 2 will continue until spring 60 is fully compressed between abutment surfaces 44' and 49 as shown in FIG. 2. In this configuration, the lower end 66 of valve means 40 has moved past passage means 49 and passage means 39 is open for communication of fluid and pressure from the interior 16 of tubular member 10 by means of inlet passage 36 and bore means 28**.

Valve means 42 at this time is still in the configuration shown in FIGS. 1 and 2 and is held there by shear pin 78, allowing fluid to be communicated from passage means 39 into reduced portion 82 and through surge passage means 80, into reduced portion 84 and through fluid channel 18 in valve body 14 for subsequent discharge internally of the inflatable element 20.

With passage means 39 open for communication with the interior 16 of tubular member 10, fluid surges from passage means 39 into reduced portion 84 and into the inlet 83 to surge passage means 80. As the flowstream reaches intermediate portion 86, its flow direction is altered to an upwards direction along the axis of valve means 42 that is normal to its inlet 83 direction. As the flowstream reaches outlet portion 85, its flow direction is again altered to a direction which is both normal to intermediate portion 86 and parallel to the flowstream of both passage means 39 and inlet 83.

As the fluid from interior 16 surges through surge passage means 80, inlet 83 and outlet 85 portions have aforementioned complementary opposed facing surfaces **82*a* and 84*a* having equal surface areas. These surfaces 82*a* and 84*a* together with intermediate passage 86 provide a means by which fluid surge is restrained from prematurely closing off of fluid to the inflatable element 20. These surfaces are parallel to each other so that the pressure exerted by the surging fluid as it passes through surge passage means 80 exerts equal and opposite axial forces on surfaces 82*a* and 84*a*, and hence valve means 42. These opposite forces cancel each other out, and as is further appreciated the direction of the intermediate passage section 86 is along the axis of valve means 42 so that forces generated as the fluid surges through intermediate passage section 86 are balanced and no further substantial net axial force is generated on valve means 42. In this manner, surge passage means 80 cooperates with shear pin 78 to aid in restraining the premature movement of valve means 30** responsive to fluid surge.

Figure 3:
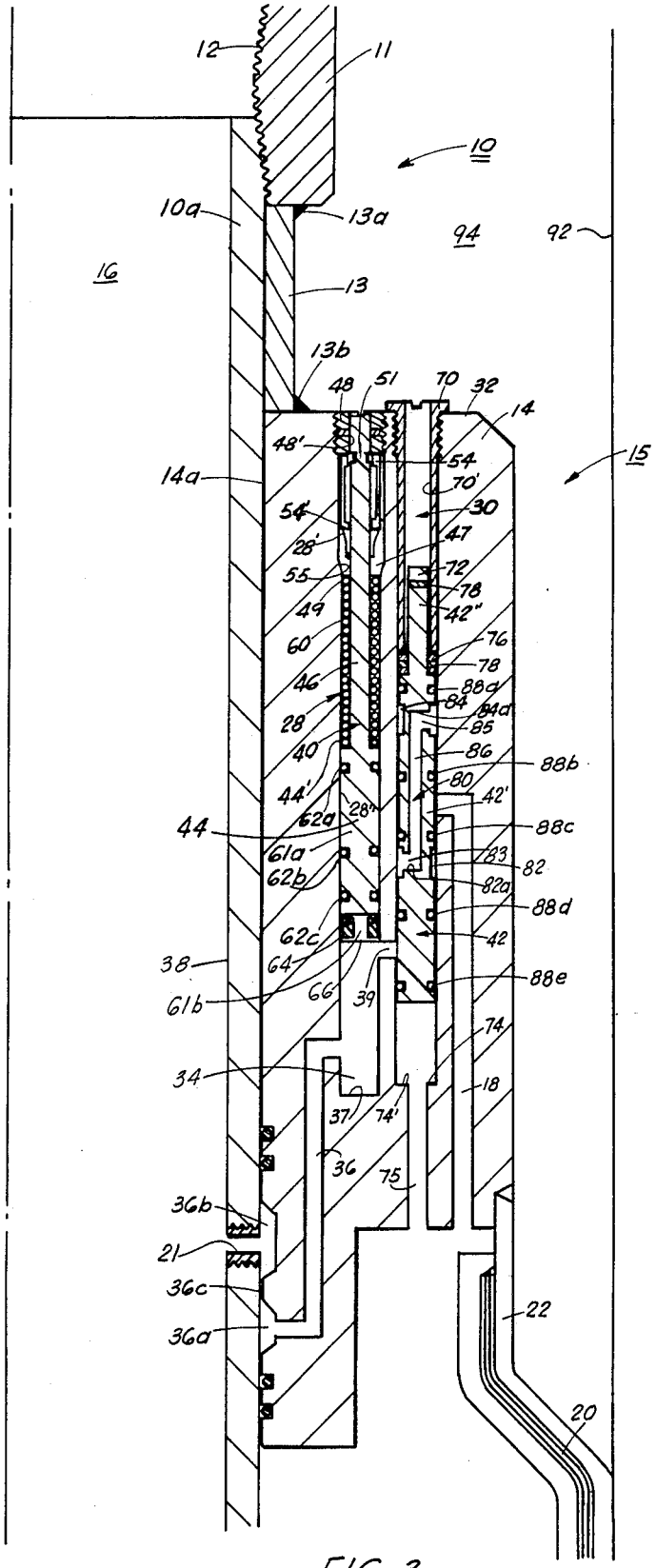
FIG. 3 is a further sectional view similar to FIG. 1 and illustrating the relationship of the valve means when the inflate pressure has moved the second valve means to a blocking position to block off communication between the bore means and the inflatable element.

Communication between the interior 16 of tubular member 10 and the interior of inflatable element 20 is continued until a second predetermined pressure differential between a higher pressure from the inflatable element 20 and a lower pressure in the annulus 94 is reached, which may be the same, less or greater than the pressure differential which caused the shear pin 52 to shear. More specifically and by way of example only, the shear pin 52 may be such that it will shear when the pressure differential between the annulus 94 acting on the upper end of valve means 42 and the pressure which is communicated from inflatable element 20 by means of passage 75 to act on the lower end of valve means 42 is 750–3000 p.s.i. When this occurs, second valve means 42 is released to shift longitudinally of bore means 28 and stem 42'' thereof telescopes into bore 70'. This positions valve means 42 as shown in FIG. 3 with seal members **88*b* and 88*c* blocking off fluid channel 18 to prevent further communication between surge passage means 80 in valve means 42 and fluid channel 18 as well as seal members 88*d* and 88*e* blocking off passage means 39 to prevent further communication between passage means 39 and surge passage means 80**.

At such time, the inflate pressure from tubular member 10 may be reduced to a third predetermined pressure differential below the inflating pressure, or below the force of spring 60 which enables the spring 60 to thereupon urge first valve means 40 to move longitudinally downwards. As valve means 40 moves downwards, lower end 66 passes inlet passage 36 to block further fluid communication between inlet passage 36 and passage means 39. As lower end 66 passes inlet passage 36, the seal which is configured to seal against flow in the downwards direction around the seal while allowing flow in the upwards direction around the seal, such as seal member 64 or a check valve as previously described, allows valve means 40 to continue to move downwards by allowing the fluid trapped below end 66 to flow up and around seal member 64 as previously mentioned, and be displaced by the lower end 66 as valve means 40 continues to move longitudinally downwards into the extension 34 of bore means 28 until end 66 abuts against the closed end 37 of bore means 28 and valve means 40 assumes the configuration as shown in FIG. 4.

Figure 4:
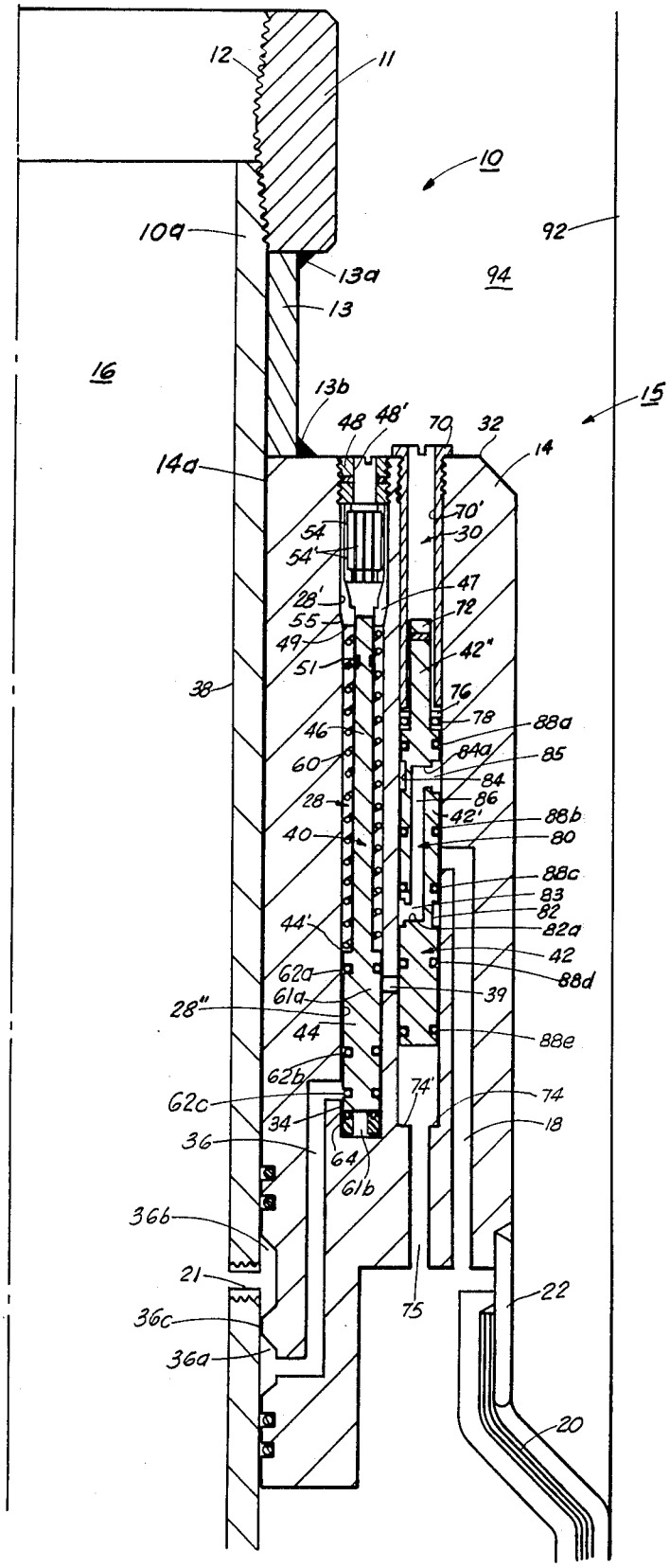
FIG. 4 is a further sectional view similar to FIG. 1 and illustrating the relationship of the valve means when the the annulus pressure has moved the first valve means to a further position in which further flow between the interior of the tubular member through the valve apparatus and the inflatable element is blocked off.

With the valve means 40 in the configuration as shown in FIG. 4, seal members **62*a* and 62*b* block off passage means 39 to prevent further communication between inlet passage 36 and passage means 39. Further upwards movement of first valve means 40 from the configuration shown in FIG. 4 is restrained by the seal which is configured to seal in the downwards direction such as seal member 64 or the previously mentioned check valve preventing the downwards leakage of pressurized fluid, as previously described, below end 66 to restrain valve means 40 from further moving longitudinally upwards responsive to a pressure differential between a higher pressure in the interior 16 of the tubular member 10 and a lower pressure in the annulus 94**.

It will be noted, that with valve means 40 in the configuration as shown in FIG. 4, further communication between the interior 16 of tubular member 10 and the inflatable element 20 is restrained. Should inflatable element 20 for any reason become punctured or lose its inflate pressure and second valve means 42 move longitudinally downwards to its configuration as shown in FIGS. 1 and 2, allowing communication between surge passage means 80 and fluid channel 18, further communication between port 21, inlet passage 36 and passage means 39 is blocked by first valve means 40. Also, if inflatable element 20 ruptures before valve means 42 shifts to the configuration as shown in FIG. 3, lowering the pressure in the interior 16 of tubular member 10 to a point below the pressure in the annulus 94, will allow valve means 40 to close and block further communication between port 21, inlet passage 36 and passage means 39. This prevents further fluid flow from the interior 16 of tubular member through inlet passage 36 and fluid channel 18 into punctured element, or as the case may be from annulus 94 fluid flowing into the punctured element 20 through fluid channel 18 and inlet passage 36 into the interior 16 of tubular member 10. As may be appreciated this will prevent a higher pressure fluid in the interior 16 of tubular member 10 from flowing through inlet passage 36 into punctured inflatable element 20 and hence into the annulus 94, while at the same time preventing a higher pressure fluid in the annulus 94 from flowing into the inflatable element 20 and hence into the interior of tubular member 10 by means of inlet passage 36.

The foregoing disclosure and description of the invention is illustrative and explanatory thereof, and various changes in the method steps as well as in the details of the illustrated apparatus may be made within the scope of the appended claims without departing from the spirit of the invention. It is further within the scope of the invention that the invention may be provided with a bore means 28 and 30 which are disposed in a configurations other than the axial alignment as shown, and that the valve apparatus 15 may be included in a valve block to be fastened in a recess in the valve body 14, allowing the valve apparatus 15 to be easily removed for disassembly and repairs when necessary.

What is claimed is:

1. Apparatus, comprising:

a. a valve housing means adapted to be supported on a tubular member;

b. bore means in said valve housing means;

c. passage means in the tubular member and in said valve housing means for communicating fluid from the interior of the tubular member to the bore means and to the interior of an inflatable element supported externally on the tubular member to inflate it;

d. valve means disposed in said bore means for controlling fluid flow through said bore means; and e. means disposed in said bore means to restrain said valve means from moving responsive to a first pressure differential between a higher pressure in an annulus surrounding said tubular member and a lower pressure in said bore means, said means to restrain including collet means disposed in said bore means in a configuration to restrain movement therein responsive to said first pressure differential, hook means included with said collet means engaged with said valve means to lock and restrain the movement of said valve means responsive to said first pressure differential, and means for releasing said valve means for movement responsive to a lower pressure differential from a higher pressure from the interior of said tubular member and a lower pressure in the annulus for further movement responsive to a further pressure differential between a higher pressure in the annulus and a lower pressure from the interior of said tubular member, said means for releasing including disengagement means for the disengagement of said hook means from said valve means as said valve means moves responsive to said lower pressure differential to allow said hook means to move to a disengaged position on said valve means and allow said valve means to further move in said bore means responsive to said further pressure differential.

2. The apparatus of claim 1, wherein said valve means moves responsive to a pressure differential between a higher pressure in the annulus and a lower pressure from the interior of said tubular member to a third configuration in which further movement responsive to a higher pressure from the interior of said tubular member and a lower pressure in the annulus is restrained.

3. The apparatus of claim 2, wherein the first configuration prevents communication between the interior of the said tubular member and the inflatable element, and the second configuration when released responsive to a lower pressure differential between a higher pressure from the interior of said tubular member and a lower pressure in the annulus is an open position in which communication exists between the interior of the tubular member and said inflatable element, and the third configuration is a further closed position in which communication between the interior of said tubular member and said inflatable element is blocked.

4. The apparatus of claim 1, wherein said bore means includes first and second bore means, and wherein said valve means includes a first valve means disposed in said first bore means and a second valve means disposed in said second bore means.

5. The apparatus of claim 4, wherein said apparatus includes a means associated with said second valve means for restraining a fluid surge from the interior of said tubular member from prematurely closing off of fluid flow to the inflatable element before its inflation thereof.

6. The apparatus of claim 4, wherein there is included a passage means communicating said first and second bore means and wherein said second valve means is disposed in said second bore means in a configuration so that communication is available from said first bore means to said inflatable element.

7. The apparatus of claim 1, wherein said valve means comprises a piston valve means.

8. Apparatus, comprising:

a. a valve housing means adapted to be supported on a tubular member;

b. bore means in said valve housing means;

c. passage means in the tubular member and in said valve housing means for communicating fluid from the interior of the tubular member to the bore means and to the interior of an inflatable element supported externally on the tubular member to inflate it;

d. valve means disposed in said bore means for controlling fluid flow through said bore means; and e. means included with said valve means providing a fluid surge control passage and having means for restraining the opening of said surge control passage responsive to a first pressure differential between a higher pressure in an annulus surrounding said tubular member and a lower pressure from the interior of said tubular member, said means for restraining including collet means slidably disposed in said bore means in a configuration with said bore means to restrain movement therein responsive to said first pressure oifferential in said bore means, hook means included with said collet means engaged with said valve means to lock and restrain the movement of said valve means responsive to said first pressure differential, and means for releasing said valve means for movement responsive to a lower pressure differential from a higher pressure from the interior of said tubular member and a lower pressure in the annulus for further movement responsive to a further pressure differential between a higher pressure in the annulus and a lower pressure from the interior of said tubular member, said means for releasing including disengagement means for the disengagement of said hook means from said valve means to allow said hook means to ride along said valve means as said valve means moves responsive to said lower pressure differential to a position on said valve means having said hook means diesengaged from said valve means to allow said valve means to further move in said bore means responsive to said further pressure differential.

9. The apparatus of claim 8, wherein said valve means moves responsive to a pressure differential between a higher pressure in the annulus and a lower pressure from the interior of said tubular member to a third configuration in which further movement responsive to a higher pressure from the interior of said tubular member and a lower pressure in the annulus is restrained.

10. The apparatus of claim 9, wherein the first configuration prevents communication between the interior of the said tubular member and the inflatable element, and the second configuration when released responsive to a lower pressure differential between a higher pressure from the interior of said tubular member and a lower pressure in the annulus is an open position in which communication exists between the interior of the tubular member and said inflatable element, and the third configuration is a further closed position in which communication between the interior of said tubular member and said inflatable element is blocked.

11. The apparatus of claim 8, wherein said bore means includes first and second bore means, and wherein said valve means includes a first valve means disposed in said first bore means and a second valve means disposed in said second bore means.

12. The apparatus of claim 11, wherein said apparatus includes a means associated with said second valve means for restraining a fluid surge from the interior of said tubular member from prematurely closing off of fluid flow to the inflatable element before its inflation thereof.

13. The apparatus of claim 11, wherein there is included a passage means communicating said first and second bore means and wherein said second valve means is disposed in said second bore means in a configuration so that communication is available from said first bore means to said inflatable element.

14. The apparatus of claim 8, wherein said valve means comprises a piston valve means.

15. Apparatus, comprising:

a. a valve housing means adapted to be supported on a tubular member;

b. bore means in said valve housing means;

c. passage means in the tubular member and in said valve housing means for communicating fluid from the interior of the tubular member to the bore means and to the interior of an inflatable element supported externally on the tubular member to inflate it;

d. first valve means disposed in said bore means for controlling fluid flow through said bore means;

e. second valve means in said bore means for controlling fluid flow from said bore means to the inflatable element;

f. means to retain said first valve means in a closed configuration in said bore means and close off flow through said bore means, until a predetermined opening pressure differential is reached in said bore means, and for releasing said first valve means so that it may move to an open configuration and communicate said bore means with the interior of the inflatable element for flow therethrough when said predetermined opening pressure differential is reached;

g. means to retain said second valve means in an open configuration in said bore means to accommodate flow to said bore means until a second predetermined pressure differential is reached in said bore means, and for releasing said second valve means to move to a closed configuration and close off flow to said inflatable element when the second predetermined pressure differential is reached; and h. means disposed in said bore means to restrain said first valve means from moving prematurely responsive to a first pressure differential between a higher pressure in an annulus surrounding said tubular member and a lower pressure in said bore means, said means to restrain including collet means slidably disposed in said bore means in a configuration with said bore means to restrain movement therein responsive to said first pressure differential, hook means included with said collet means engaged with said first valve means to lock and restrain the movement of said first valve means responsive to said first pressure differential in said bore means, and means for releasing said first valve means for movement responsive to said opening pressure differential between a higher pressure from the interior of said tubular member and a lower pressure in the annulus, said opening pressure differential being a lower pressure differential than said first pressure differential, said means for releasing including disengagement means for the disengagement of said hook means from said first valve means to allow said hook means to ride along said first valve means as said first valve means moves responsive to said opening pressure differential to a position on said first valve means having said hook means disengaged from said first valve means, for allowing further movement of said first valve means responsive to a further pressure differential between a higher pressure in the annulus and a lower pressure from the interior of said tubular member, to a further configuration having means to restrain said first valve means from further movement in response to a further pressure increase from the interior of said tubular member, in which said first valve means is restrained from further movement.

16. The apparatus of claim 15, wherein said second predetermined pressure differential is less than the said first predetermined pressure differential.

17. The apparatus of claim 15, wherein said second predetermined pressure differential is the same as said first predetermined pressure differential.

18. The apparatus of claim 15, wherein said second predetermined pressure differential is higher than said first predetermined pressure differential.

19. The apparatus of claim 15, wherein the first configuration prevents communication between the interior of the said tubular member and the inflatable element, and the second configuration when released responsive to a lower pressure differential between a higher pressure from the interior of said tubular member and a lower pressure in the annulus is an open position in which communication exists between the interior of the tubular member and said inflatable element, and the further configuration is a closed position in which communication between the interior of said tubular member and said inflatable element is blocked.

20. The apparatus of claim 19, wherein said apparatus includes a means associated with said second valve means for restraining a fluid surge from the interior of said tubular member from prematurely closing off of fluid flow to the inflatable element before its inflation thereof.

21. The apparatus of claim 15, wherein said valve means comprises a piston valve means.

22. A method of inflating an inflatable element, comprising the steps of:

a. lowering a tubular member having a valve housing means adapted to be supported thereon, into a well;

b. locking a valve means disposed in a bore means in the valve housing means in a first configuration to restrain movement of the valve means responsive to a pressure differential between a higher pressure in an annulus surrounding the tubular member and a lower pressure in the bore means;

c. communicating the interior of the tubular member with the bore means so that fluid and pressure from the interior of the tubular member may be communicated to the bore means;

d. releasing the valve means for movement responsive to a pressure differential between a higher pressure from the interior of the tubular member and a lower pressure in the annulus;

e. moving the valve means to a second configuration responsive to a first predetermined pressure differential between a higher pressure from the interior of the tubular member and a lower pressure in the annulus to communicate fluid from the interior of the tubular member to the interior of an inflatable element supported externally on the tubular member to inflate it; and f. moving the valve means to a third configuration responsive to a pressure differential between a higher pressure in the annulus and a lower pressure from the interior of the tubular member to close and block off communication between the interior of the tubular member and the inflatable element, and restraining the valve means from further movement responsive to a pressure differential between a higher pressure from the interior of the tubular member and a lower pressure in the annulus.

23. A method of inflating an inflatable element, comprising the steps of:

a. lowering a tubular member having a valve housing means adapted to be supported thereon, into a well;

b. locking a first valve means disposed in a bore means in the valve housing means in a first configuration to restrain movement of the valve means responsive to a pressure differential between a higher pressure in an annulus surrounding the tubular member and a lower pressure in the bore means;

c. communicating the interior of the tubular member with the bore means so that fluid and pressure from the interior of the tubular member may be communicated to the bore means;

d. releasing the first valve means for movement responsive to a higher pressure from the interior of the tubular member and a lower pressure in the annulus;

e. moving the first valve means to a second configuration responsive to a first predetermined pressure differential between a higher pressure from the interior of the tubular member and a lower pressure in the annulus to communicate fluid from the interior of the tubular member through an open second valve means disposed in the bore means to the interior of an inflatable element supported externally on the tubular member to inflate it;

f. providing the second valve means with a fluid surge control passage so that the second valve means may be restrained from prematurely moving to a closed configuration responsive to fluid surge pressure and prematurely close off flow to the inflatable element; and g. moving the valve means to a third configuration responsive to a pressure differential between a higher pressure in the annulus and a lower pressure from the interior of the tubular member to close and block off communication between the interior of the tubular member and the inflatable element, and restraining the valve means from further movement responsive to a pressure differential between a higher pressure from the interior of the tubular member and a lower pressure in the annulus.

24. The method of claim 23, wherein the method includes the additional step of closing the second valve means responsive to a second predetermined pressure differential between a higher pressure in the inflatable element and a lower pressure in the annulus.

25. The method of claim 24, wherein the additional step of closing the second valve means, comprises closing the second valve means responsive to a second predetermined pressure differential which is the same as the first predetermined pressure differential.

26. A method of inflating an inflatable element, comprising the steps of:

a. lowering a tubular member having a valve housing means adapted to be supported thereon, into a well;

b. locking a first valve means disposed in a bore means in the valve housing means in a first configuration to restrain movement of the valve means responsive to a pressure differential between a higher pressure in an annulus surrounding the tubular member and a lower pressure in the bore means;

c. communicating the interior of the tubular member with the bore means so that fluid and pressure from the interior of the tubular member may be communicated to the bore means;

d. releasing the first valve means for movement responsive to a pressure differential between a higher pressure from the interior of the tubular member and a lower pressure in the annulus;

e. moving the first valve means to a second configuration responsive to a first predetermined pressure differential between a higher pressure from the interior of the tubular member and a lower pressure in the annulus to communicate fluid from the interior of the tubular member through an open second valve means disposed in the bore means to the interior of an inflatable element supported externally on the tubular member to inflate it;

f. providing the second valve means with a fluid surge control passage means so that the second valve means may close responsive to a second predetermined pressure differential between a higher pressure in the inflatable element and a lower pressure in the annulus which is the same as the first pressure differential; and g. moving the valve means to a third configuration responsive to a pressure differential between a higher pressure in the annulus and a lower pressure from the interior of the tubular member to close and block off communication between the interior of the tubular member and the inflatable element, and restraining the valve means from further movement responsive to a pressure differential between a higher pressure from the interior of the tubular member and a lower pressure in the annulus.

27. The apparatus of claim 15, wherein said first valve means moves responsive to said opening pressure differential to a position on said first valve means having said hook means disengaged from said first valve means, and wherein said further movement occurs after said second predetermined pressure differential is reached in said bore means for releasing said second valve means to move to said closed configuration.

28. The apparatus of claim 15, wherein said further pressure differential is intermediate said opening pressure differential and said second pressure differential.

* * * * *